US008721460B2

(12) United States Patent
Rosenblum

(10) Patent No.: US 8,721,460 B2
(45) Date of Patent: May 13, 2014

(54) TOY LASER GUN AND LASER TARGET SYSTEM

(75) Inventor: Brian Rosenblum, Sherman Oaks, CA (US)

(73) Assignee: JAKKS Pacific, Inc., Malibu, CA (US)

( * ) Notice: Subject to any disclaimer, the term of this patent is extended or adjusted under 35 U.S.C. 154(b) by 1416 days.

(21) Appl. No.: 12/006,816

(22) Filed: Jan. 3, 2008

(65) Prior Publication Data

US 2008/0188314 A1 Aug. 7, 2008

Related U.S. Application Data

(60) Provisional application No. 60/878,930, filed on Jan. 4, 2007, provisional application No. 60/878,931, filed on Jan. 4, 2007.

(51) Int. Cl.
*A63F 9/02* (2006.01)

(52) U.S. Cl.
USPC ..... 463/52; 446/473

(58) Field of Classification Search
USPC ..... 463/52; 446/473, 219; 273/371
See application file for complete search history.

(56) References Cited

U.S. PATENT DOCUMENTS

| | | | | | |
|---|---|---|---|---|---|
| 2,284,757 | A | * | 6/1942 | Morton | 396/385 |
| 2,404,653 | A | | 7/1946 | Plebanek | |
| 2,957,693 | A | | 10/1960 | Ross | |
| 3,202,425 | A | | 8/1965 | Van Hennik | |
| 3,220,732 | A | | 11/1965 | Pincus | |
| 3,418,908 | A | * | 12/1968 | Land | 396/107 |
| 3,434,226 | A | | 3/1969 | Schaller | |
| 3,499,650 | A | | 3/1970 | Lemelson | |
| 3,508,751 | A | | 4/1970 | Meyer et al. | |
| 3,549,147 | A | | 12/1970 | Katter | |
| 3,781,512 | A | * | 12/1973 | Grubbs et al. | 219/137 R |
| 3,789,136 | A | | 1/1974 | Haith et al. | |
| 3,870,305 | A | | 3/1975 | Harclerode | |

(Continued)

FOREIGN PATENT DOCUMENTS

| | | |
|---|---|---|
| GB | 2 259 559 | 3/1993 |
| GB | 2 446 636 | 8/2008 |

(Continued)

OTHER PUBLICATIONS

PCT International Search Report and the Written Opinion of the International Searching Authority.

(Continued)

*Primary Examiner* — Seng H Lim
(74) *Attorney, Agent, or Firm* — Tope-McKay & Associates

(57) ABSTRACT

The present invention relates to a toy gun capable of transmitting a laser beam and/or an infrared ("IR") beam of light for use in a game. The toy gun also has a detector for detecting a laser and IR signal. A controller within the gun tracks the number of shots fired, the type of light beam fired, the number of hits received by other guns, and permits the user to alternate between firing an IR beam or laser beam. The toy gun also has unique features available through the use of lasers, including detecting the distance to a target. The present invention further relates to an interactive electronic targeting system for use with a toy laser gun. The targeting system includes an electronic multi-colored backlit board with light detecting sensors positioned within the board. The targeting system is programmed with multiple interactive games for use with a toy gun.

21 Claims, 6 Drawing Sheets

(56) References Cited

U.S. PATENT DOCUMENTS

| | | | | | |
|---|---|---|---|---|---|
| 3,898,747 | A | | 8/1975 | Marshall | |
| 3,960,380 | A | | 6/1976 | Yokoi | |
| 3,995,376 | A | | 12/1976 | Kimble et al. | |
| 4,131,354 | A | * | 12/1978 | Hagiwara | 396/385 |
| 4,164,081 | A | | 8/1979 | Berke | |
| 4,171,811 | A | | 10/1979 | Meyer et al. | |
| 4,233,770 | A | * | 11/1980 | de Filippis et al. | 42/114 |
| 4,266,776 | A | | 5/1981 | Goldfarb | |
| 4,267,606 | A | | 5/1981 | Stelter et al. | |
| 4,375,106 | A | | 2/1983 | Voll | |
| 4,403,421 | A | * | 9/1983 | Shepherd | 42/122 |
| 4,426,662 | A | | 1/1984 | Skerlos et al. | |
| 4,533,144 | A | | 8/1985 | Juarez et al. | |
| 4,586,715 | A | | 5/1986 | Scolari et al. | |
| D286,308 | S | | 10/1986 | Mayer et al. | |
| 4,629,427 | A | | 12/1986 | Gallagher | |
| 4,695,058 | A | | 9/1987 | Carter, III et al. | |
| 4,754,133 | A | | 6/1988 | Bleich | |
| 4,772,028 | A | | 9/1988 | Rockhold et al. | |
| 4,781,593 | A | | 11/1988 | Birge et al. | |
| 4,802,675 | A | | 2/1989 | Wong et al. | |
| 4,807,031 | A | | 2/1989 | Broughton et al. | |
| 4,808,143 | A | | 2/1989 | Kuo | |
| 4,844,475 | A | | 7/1989 | Saffer et al. | |
| D303,130 | S | | 8/1989 | Noble | |
| 4,898,391 | A | | 2/1990 | Kelly et al. | |
| RE33,229 | E | | 6/1990 | Schwaber | |
| D308,400 | S | | 6/1990 | Ferri | |
| 4,931,028 | A | | 6/1990 | Jaeger et al. | |
| 4,938,483 | A | | 7/1990 | Yavetz | |
| D316,123 | S | | 4/1991 | Shiung-Fei | |
| 5,029,872 | A | | 7/1991 | Sassak | |
| 5,180,875 | A | * | 1/1993 | Berry et al. | 42/122 |
| 5,181,323 | A | * | 1/1993 | Cooper | 42/122 |
| 5,253,068 | A | | 10/1993 | Crook et al. | |
| 5,320,362 | A | | 6/1994 | Bear et al. | |
| 5,354,057 | A | | 10/1994 | Pruitt et al. | |
| 5,369,432 | A | | 11/1994 | Kennedy | |
| 5,375,847 | A | | 12/1994 | Fromm et al. | |
| 5,401,025 | A | | 3/1995 | Smith, III et al. | |
| 5,437,463 | A | | 8/1995 | Fromm | |
| 5,491,546 | A | * | 2/1996 | Wascher et al. | 356/4.03 |
| 5,495,676 | A | * | 3/1996 | Chesnut et al. | 42/129 |
| 5,528,264 | A | | 6/1996 | Kautzer et al. | |
| 5,552,917 | A | | 9/1996 | Darbee et al. | |
| 5,577,962 | A | | 11/1996 | Kounoe et al. | |
| 5,656,907 | A | | 8/1997 | Chainani et al. | |
| 5,672,108 | A | | 9/1997 | Lam et al. | |
| 5,741,185 | A | | 4/1998 | Kwan et al. | |
| 5,788,500 | A | | 8/1998 | Gerber | |
| 5,904,621 | A | * | 5/1999 | Small et al. | 463/52 |
| 6,007,429 | A | | 12/1999 | Lubniewski | |
| 6,248,019 | B1 | * | 6/2001 | Mudie et al. | 463/49 |
| 6,302,796 | B1 | * | 10/2001 | Lebensfeld et al. | 463/51 |
| 6,429,970 | B2 | * | 8/2002 | Ruh | 359/428 |
| 6,443,142 | B1 | * | 9/2002 | Wiseby et al. | 124/87 |
| 6,450,816 | B1 | * | 9/2002 | Gerber | 434/11 |
| 6,516,551 | B2 | * | 2/2003 | Gaber | 42/132 |
| 6,542,302 | B2 | * | 4/2003 | Cross | 359/581 |
| 6,648,726 | B2 | * | 11/2003 | Hornsby et al. | 446/483 |
| 6,672,962 | B1 | * | 1/2004 | Ozaki et al. | 463/37 |
| 6,705,037 | B2 | * | 3/2004 | Van Kirk | 42/126 |
| 6,890,178 | B2 | * | 5/2005 | Gouko et al. | 434/19 |
| 7,306,523 | B1 | * | 12/2007 | Jeffway et al. | 463/51 |
| 7,325,318 | B2 | * | 2/2008 | Roes | 33/227 |
| 7,338,375 | B1 | * | 3/2008 | Small | 463/39 |
| 7,585,080 | B2 | * | 9/2009 | Ballard | 359/511 |
| 7,632,187 | B1 | * | 12/2009 | Farley et al. | 463/53 |
| 7,846,028 | B2 | * | 12/2010 | Small et al. | 463/51 |
| 2002/0041440 | A1 | * | 4/2002 | Cross | 359/581 |
| 2002/0081939 | A1 | * | 6/2002 | Hornsby et al. | 446/268 |
| 2002/0137567 | A1 | * | 9/2002 | Cheng | 463/51 |
| 2003/0072082 | A1 | * | 4/2003 | Cross | 359/581 |
| 2003/0091960 | A1 | | 5/2003 | Rosa et al. | |
| 2003/0192224 | A1 | * | 10/2003 | Van Kirk | 42/124 |
| 2005/0074727 | A1 | | 4/2005 | Hull et al. | |
| 2005/0153262 | A1 | | 7/2005 | Kendir | |
| 2006/0107579 | A1 | * | 5/2006 | Thomas | 42/119 |
| 2006/0254115 | A1 | * | 11/2006 | Thomas et al. | 42/122 |
| 2006/0287113 | A1 | * | 12/2006 | Small et al. | 463/51 |
| 2007/0062092 | A1 | * | 3/2007 | Roes | 42/140 |
| 2007/0160960 | A1 | | 7/2007 | Manard et al. | |
| 2007/0166667 | A1 | * | 7/2007 | Jones et al. | 434/11 |
| 2008/0186584 | A1 | * | 8/2008 | Ballard | 359/611 |
| 2009/0005196 | A1 | * | 1/2009 | Kessler et al. | 473/476 |
| 2009/0019758 | A1 | * | 1/2009 | Baugher | 42/111 |
| 2009/0038203 | A1 | * | 2/2009 | McCarty | 42/147 |
| 2009/0064979 | A1 | * | 3/2009 | Andrews | 124/65 |
| 2010/0093414 | A1 | * | 4/2010 | Jensen | 463/5 |
| 2010/0093436 | A1 | * | 4/2010 | Lander | 463/37 |
| 2012/0055063 | A1 | * | 3/2012 | Lindau et al. | 42/113 |

FOREIGN PATENT DOCUMENTS

| | | |
|---|---|---|
| WO | WO 94/03770 | 2/1994 |
| WO | WO 03/067175 | 8/2003 |
| WO | WO 03/095047 | 11/2003 |
| WO | WO 2005/045573 | 5/2005 |

OTHER PUBLICATIONS

PCT International Preliminary Report on Patentability.

* cited by examiner

TOY LASER GUN AND LASER TARGET SYSTEM

The present application is a non-provisional patent application, claiming the benefit of priority of U.S. Provisional Patent Application No. 60/878,930, filed Jan. 4, 2007, titled, "Toy Laser Gun Targeting System," as well as the benefit of priority of U.S. Provisional Patent Application No. 60/878,931, filed Jan. 4, 2007, titled, "Laser and Infrared Transmitting Gun."

BACKGROUND OF THE INVENTION

Technical Field

The present invention relates to the field of simulated projectile guns and, more specifically, to a toy gun capable of transmitting a laser and infrared signal for use in a game and corresponding moving and stationary targeting systems for use with the toy gun.

SUMMARY OF THE INVENTION

The present invention relates to a toy gun capable of firing a laser beam and an infrared ("IR") beam of light for use in a game. The toy gun also has a detector for detecting a laser and IR signal. A controller within the gun tracks the number of shots fired, the type of light beam fired, the number of hits received by other guns, and permits the user to alternate between firing an IR beam or laser beam. The toy gun also has unique features available through the use of lasers, including detecting the distance to a target. Additionally, the laser beam is optionally made to pass through a special lens in the toy gun to accommodate multiple skill levels of play. The toy gun also comprises a multi-function scope for aiding a user in accurately firing the toy gun. A variety of grip, barrel, and gun stabilizing attachments have also been contemplated.

The present invention further relates to an electronic targeting system for use with a toy laser gun. The targeting system includes an electronic multi-colored backlit board with numerous laser-light detecting sensors positioned within the board. The targeting system is programmed with multiple games that a user can play with a laser-emitting toy gun.

BRIEF DESCRIPTION OF THE DRAWINGS

The objects, features and advantages of the present invention will be apparent from the following detailed descriptions of the disclosed aspects of the invention in conjunction with reference to the following drawings, where.

DETAILED DESCRIPTION

Figure 1:
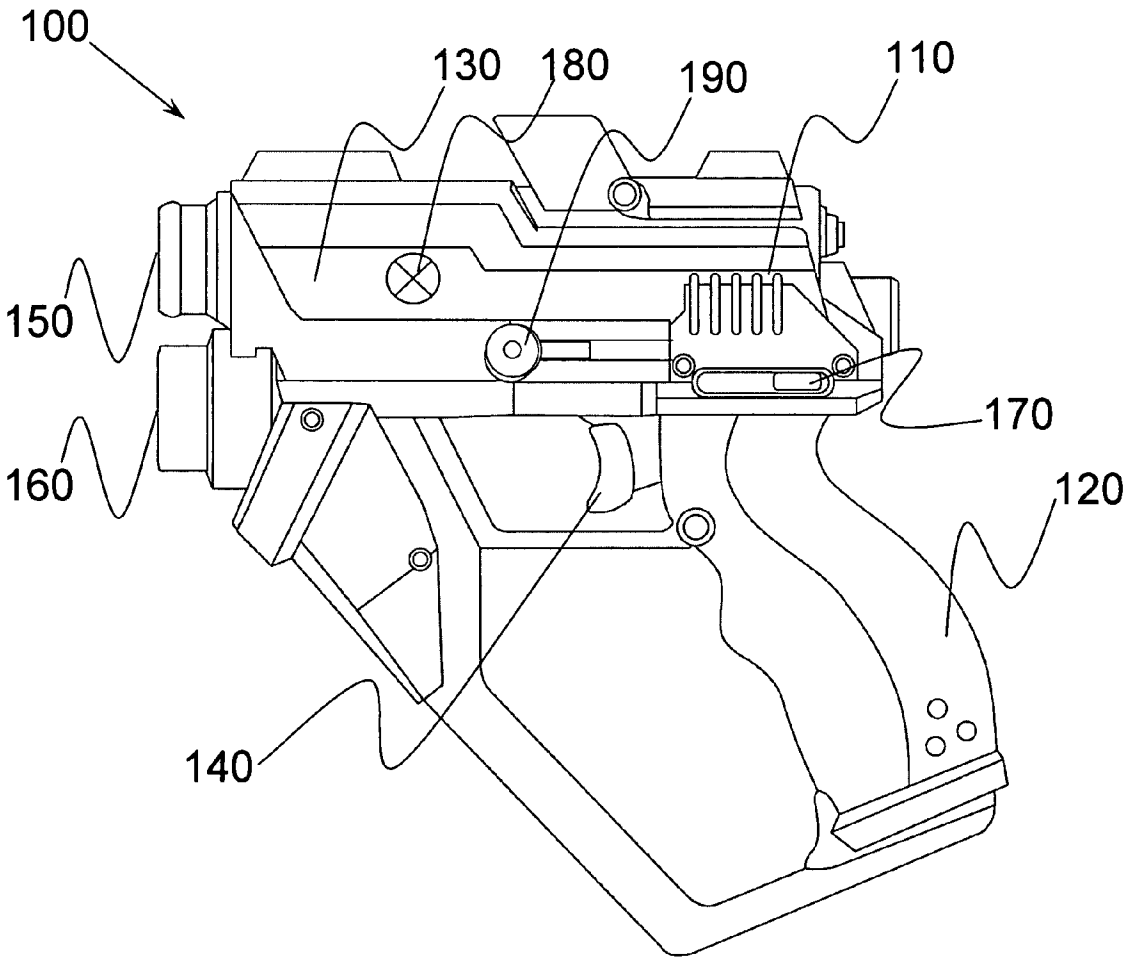
FIG. 1 is a side-view illustration of one embodiment of a toy gun according to the present invention, depicting a toy gun body, a trigger, a first barrel for transmitting an infrared ("IR") signal, and a second barrel for transmitting a laser signal.

The present invention relates to a toy gun capable of transmitting a laser beam and an infrared ("IR") beam of light for use in a game. The toy gun also has detectors for detecting a laser and IR signal. A processor within the gun tracks the number of shots fired, the number of hits received by other guns, and permits the user to alternate between firing an IR or laser beam. Additionally, the laser beam passes through a special lens in the toy gun designed to modify the beam for different skill levels of play. The toy gun also comprises a multi-function scope for aiding a user in playing the game. The following description, taken in conjunction with the referenced drawings, is presented to enable one of ordinary skill in the art to make and use the invention and to incorporate it in the context of particular applications.

The present invention relates to an electronic targeting system for use with a toy laser gun. The targeting system includes an electronic, multi-colored backlit board with numerous laser-light detecting sensors positioned within the board. The targeting system is programmed with multiple games that a user can play with a laser-emitting toy gun. The following description, taken in conjunction with the referenced drawings, is presented to enable one of ordinary skill in the art to make and use the invention and to incorporate it in the context of particular applications. Various modifications, as well as a variety of uses in different applications, will be readily apparent to those skilled in the art, and the general principles, defined herein, may be applied to a wide range of embodiments. Thus, the present invention is not intended to be limited to the embodiments presented, but is to be accorded the widest scope consistent with the principles and novel features disclosed herein. Furthermore, it should be noted that unless explicitly stated otherwise, the figures included herein are illustrated diagrammatically and without any specific scale, as they are provided as qualitative illustrations of the concept of the present invention.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents that are filed concurrently with this specification and are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 160, Paragraph 6. In particular, the use of "step of" or "act of" in the claims herein is not intended to invoke the provisions of 35 U.S.C. 160, Paragraph 6.

(1) Introduction

Referring to FIG. 1, a toy gun 100 is illustrated equipped with a gun body 110, where the gun body 110 includes a handle 120 and a barrel 130. The toy gun 100 has dual-mode capability with the unique ability to fire both an infrared ("IR") light beam as well as a laser beam from the same toy gun 100. Located within the confines of the handle 120 is a trigger 140 for firing either a laser beam or an IR beam.

In order to transmit a laser beam, the gun body 110 is equipped with a laser generator. In one non-limiting example, the laser beam is distributed out of the toy gun 100 through a laser beam emitting barrel 150. In the case of an IR beam, the toy gun 100 is also equipped with suitable circuitry in order to transmit the IR beam. As is the case with the laser beam, an IR beam is also distributed from the toy gun 100 via an IR beam barrel 160.

The toy gun 100 further includes a reload mechanism (e.g., reload button 170) which the user must periodically activate once a predetermined amount of laser beams have been fired. The reload button 170 simulates the realism of user versus user combat in which the toy gun 100 runs out of available laser beams after a predetermined amount of activations. The appearance of the reload button 170 may take on a variety of forms, one such non-limiting example includes a bolt-action mechanism which must be manually pulled back in order to reload the gun for further use. The number of laser beams emitted is monitored by a controller. The controller may include a counter module in software or gates which track the number of laser beams emitted (or the number of laser beam pulses). An activation of the reload button 170 sends a signal to the controller which resets the count.

At any time the toy gun 100 may be toggled between a pure laser beam mode, IR beam mode, and a combination of the two by adjusting the position of a beam switch 180. Optionally the toy gun 100 may also be configured with out-of-the-box functionality which would enable the simultaneous use of both the IR beam and the laser beam. In some instances, the out-of-the-box functionality may eliminate the need for a beam switch 180.

The area of the laser beam may be expanded such that a larger area increases the chances of hitting an opponent with any given shot. This may be accomplished by providing a PRO/BEGINNER switch 190 on the right side of the toy gun 100. The PRO/BEGINNER switch 190 is any suitable switching mechanism to allow a user to selectively change modes, a non-limiting example of which includes a sliding switch. A PRO mode may be selected by sliding the PRO/BEGINNER switch 190 to a forward position (in the example of a sliding switch), thereby reducing the area of the emitted laser beam and increasing the difficulty of hitting a target. Conversely, the emitted laser beam area may also be reduced by adjusting the PRO/BEGINNER switch 190 to a rear position, thereby increasing the difficulty of hitting an opponent with any given shot. The PRO/BEGINNER switch 190 allows a user to alternate between modes to enhance the gaming feature for users of varying aptitude.

The body 110 of the toy gun may include a controller, processor, or logic circuitry. The controller has the capability to provide the user with multiple additional features, such as tracking the number of shots made, the number of hits received on the IR and laser receivers, and tracking other game play features. The controller could also use the laser light beam to determine the distance to a target, helping a user determine which kind of light beam to shoot with. In one embodiment, the controller is an integrated circuit ("IC") chip or processor that is programmable with certain functions required for the toy gun to function.

(2) IR and Laser Features

Figure 2:
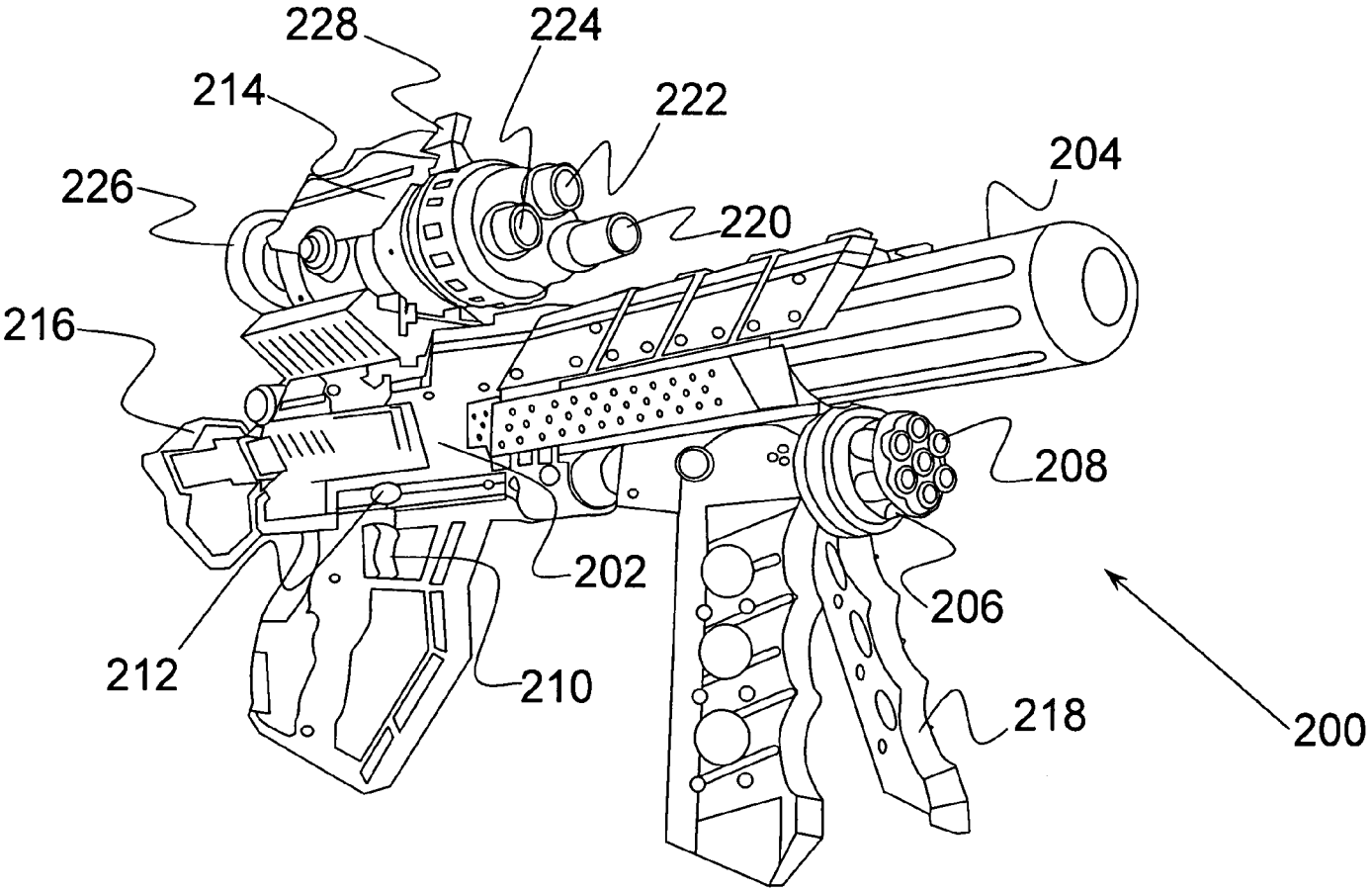
FIG. 2 is a perspective-view illustration of one embodiment of the toy gun, depicting a scope, shoulder stock, support legs, and barrel.

Referring to FIG. 2, an alternative embodiment of the toy laser gun 200 is shown. Due to the physical properties of IR light and laser light, the gun body 202 may be equipped with separate barrels (i.e., an IR barrel 204 and a laser beam barrel 206) specially adapted to transmitting the two types of light. Emitted IR light disperses quickly once generated. An unfocused IR beam of light quickly disperses, greatly increasing the ease of hitting a target. The light disperses so quickly that a user could merely fire the gun somewhere within the general proximity of a target with a high probability of success. In order to mitigate the dispersion of the IR beam, the IR barrel 204 of the toy gun 200 is configured to focus the IR beam. A focused IR beam therefore enhances the realism of the simulated game. In contrast with IR light, laser light is characteristically more narrowly focused and able to travel great distances with minimal amounts of beam spread. The laser beam barrel 206 is therefore designed with a special lens 208 which spreads the laser beam out to make it easier to hit a target. In other words, the lens 208 is positioned and used to modify (expand and/or reduce) the beam width.

The unique properties of laser light and IR light greatly enhance the gaming features of a toy gun 200. The IR beam can easily hit targets at close range and does not require great accuracy in aiming the toy gun. The IR beam has a limited distance in which it is effective, as the IR beam spreads the strength of the beam and diminishes to the point where the beam can not be detected by an IR receiver. Therefore, the laser beam is ideal for hitting targets at long range with great accuracy. The combination of both the IR beam and laser beam on a toy gun 200 provides a user with greater accuracy and ability to hit a target, regardless of the distance.

The toy gun 200 can also be equipped with an IR sensor to register "hits" from another toy gun, as is the case during game play. Similarly, the toy gun 200 may also be equipped with a laser sensor as well in order to register hits from other toy guns transmitting laser signals. In another aspect, users with toy guns 200 emitting similarly coded laser signals can wear vests equipped with laser and IR sensors capable of register hits. The vests may be configured to communicate with the toy gun 200 in order to enhance simulated combat amongst two or more users. Non-limiting examples of gaming features include disabling a user's gun upon a predetermined number of registered hits, tracking the number of registered hits from each user, as well as tracking the location of registered hits.

A controller within the body 202 of the toy gun 200 functions to control the generation of the IR and laser beam signals upon depression of the trigger 210. If a beam switch 212 is present on the gun body 202, a user may manually switch between IR and laser functionality. The beam switch 212 may also be connected to the controller. In this way, the position of the beam switch 212 may be monitored by the controller and sent as a visual reference to a visual display.

The lens 208 formed in the laser beam barrel 206 helps to spread the laser beam out to create a beam width that is acceptable for game play. For increased enjoyment, the lens 208 may also be modified such that a laser emitted from the barrel 206 may be formed into a unique pattern or unique shape. The user could then use the unique pattern or unique shape as a visual reference when aiming at a target. In another aspect, the toy gun 200 may be adapted with multiple lenses with unique patterns and beam widths. The lens 208 may be included in the gun body 202 and can be rotated into the laser beam barrel 206 as desired.

The toy gun 200 may also include a number of attachments to enhance the gaming features of the toy gun 200. The attachments may be permanently or detachably attached to the gun body 202. Non-limiting examples of suitable attachments include a scope 214, a shoulder stock 216, and support legs 218.

A scope 214 can be adapted with any number of lenses 220 or screens 222 and 224 to simulate the functionality and features of a real scope. For example, a magnification lens 220 may be adapted to augment or magnify any target viewed through a viewfinder 226 connected with the scope 214. Similarly, a number of screens 220 and 222 may be adapted with traces, such as a cross hair or body outline, which a user may use as a reference to lineup a target through the viewfinder 226. The user may rotate through the lens 220 and screens 222 and 224 by rotating a switch 228 until the appropriate lens 220 or screen 222 and 224 has been selected and is aligned with the viewfinder 226.

(3) Attachments and Assembly (3.1) Scope

Figure 3:
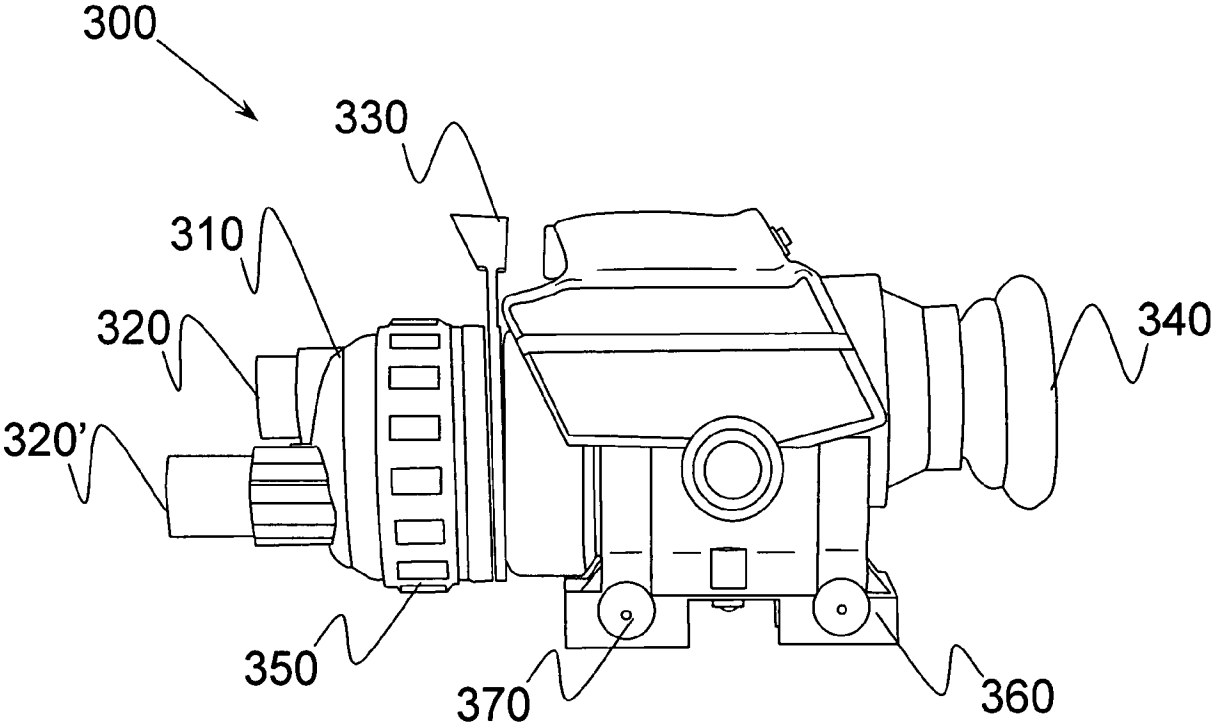
FIG. 3 is an enhanced view of the scope with multiple viewing modes.

A scope 214 may be mounted on an upper surface of the toy gun 200. The scope 214 is permanently or, in some aspects, detachably attached to the gun body 202. Referring to FIG. 3, an enhanced view of the scope 300 is shown. The scope 300 is equipped with multiple viewing modes. Each of the modes may be selected and adjusted by rotating a bezel 310, effectively rotating each of the specialized lenses 320 and 320'. As an alternative to the bezel 310, a switch 330 (or handle) may also be used to rotate the specialized lenses 320 and 320'. Each of the specialized lenses 320 and 320' are used to augment game play. The specialized lens 320 and 320' when viewed through the viewfinder 340 places a pattern in the user's field of view. Non-limiting examples of specialized lenses 320 and 320' include a normal mode, a magnifying mode, and a cross-hairs mode. Each of the views may be refined or brought into focus by adjusting the focusing ring 350.

When detachably attachable, the slide rails 360 of the scope 300 help to ensure a smooth and stable connection to the toy gun. The scope 300 is attached to the toy gun by sliding the slide rails 360 onto corresponding slide rails found on the top of the toy gun. With the scope 300 pushed as far forward as possible, the scope 300 may be configured with a notch 370. Once positioned, the notch may be configured to emit an audible alert such as a click, thereby alerting the user that the scope 300 has been secured to the toy gun. To remove the scope 300, the user can pull the scope 300 firmly backwards. The scope 300 will slide back off of the gun via the slide rails 360.

Figure 4:
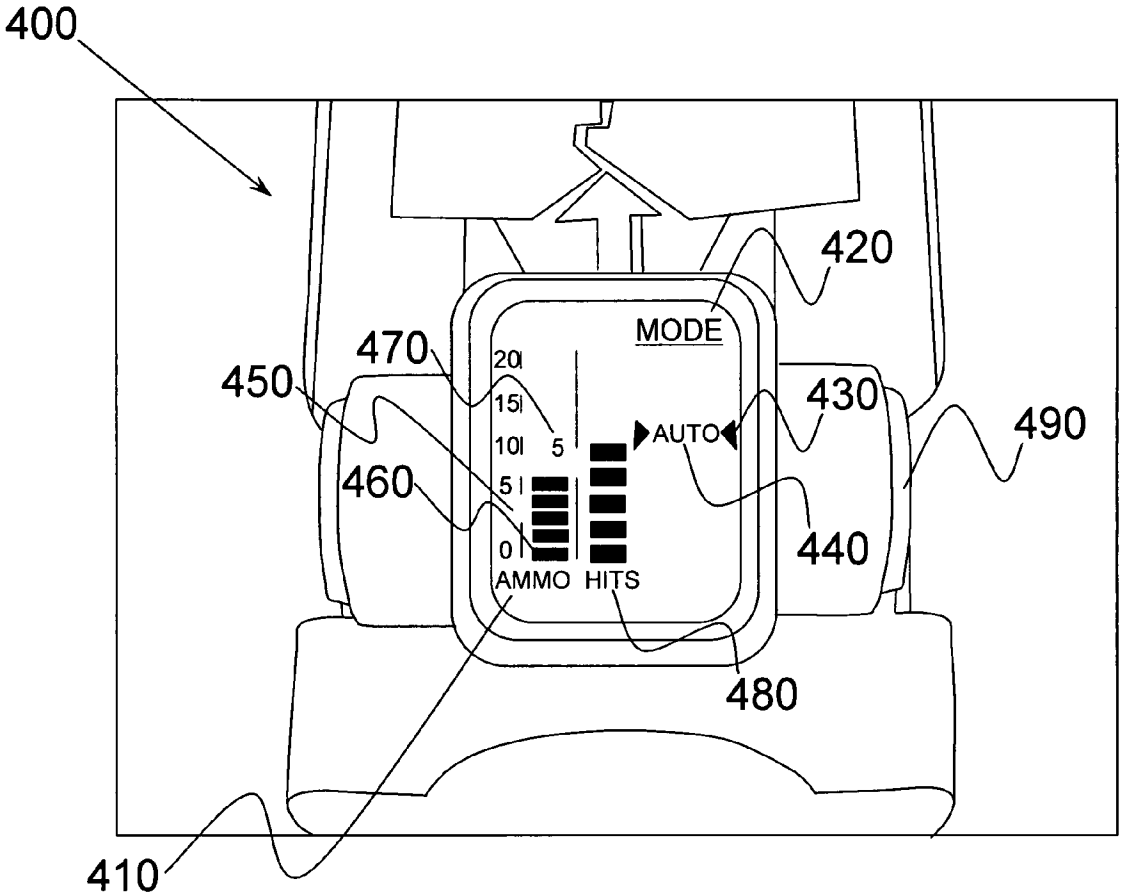
FIG. 4 is an enhanced, top, perspective-view illustration of the toy gun, depicting the toy gune equipped with a user interface.

An enhanced, top, perspective-view of the toy gun 400 is shown in FIG. 4. The top of the scope is equipped with a visual user interface, a non-limiting example of which includes a liquid crystal display (LCD) 410. Although shown on the top of the toy gun 400, an LCD 410 or other suitable visual reference cue or device may be placed on any suitable surface of the gun. Typically, data gathered by the controller is displayed on the LCD 410 display screen. A LCD may also be used to alert a user to important statistics during and after a game. A MODE 420 icon may be used to indicate which of the firing modes has been selected. An arrow 430 (or other suitable indicator) may provide a visual reference to the mode that has been selected. The words AUTO or SINGLE SHOT (or other suitable mode visuals) may also be selectively illuminated to indicate the activation 440 of a particular firing mode. Similarly, the remaining amount of laser beams which may be emitted by the toy laser gun may also be indicated by the LCD 410 as a remaining ammo indicator 450. The remaining ammo indicator 450 is any a visual cue to notify the user of the amount of remaining ammo, non-limiting examples of which include a bar graph 460 and a numerical representation 470. During TEAM MODE, the health of the user may also be illustrated graphically on the LCD 410. As the user is hit by an opposing player, the HITS graphic 480 may decrease, indicating that a direct hit has been registered. Once all of the available HITS 480 have been used up, the user may be alerted graphically by a suitable GAME OVER display. It should also be noted that any of the alerts and representations described above can also be provided via audio cues. As a non-limiting example, an intermittent chirp that increases in regularity could be used to signal decreasing levels of ammo.

The quantity, duration, and degree of focus of the emitted laser beam may also be altered by selecting a mode 420 from a fire mode selection switch 490. A variety of modes 420 have been contemplated. For example, a single shot mode 420 may be selected which causes the laser toy gun 400 to fire a single shot when the trigger is squeezed. An activation 440, such as an auto mode, has also been contemplated in which the user may rapidly fire off multiple shots each time the trigger is activated. The auto mode may also be configured to emit bursts or a continuous stream of laser as long as the trigger is suppressed.

(3.2) Toy Gun Barrel

Figure 5:
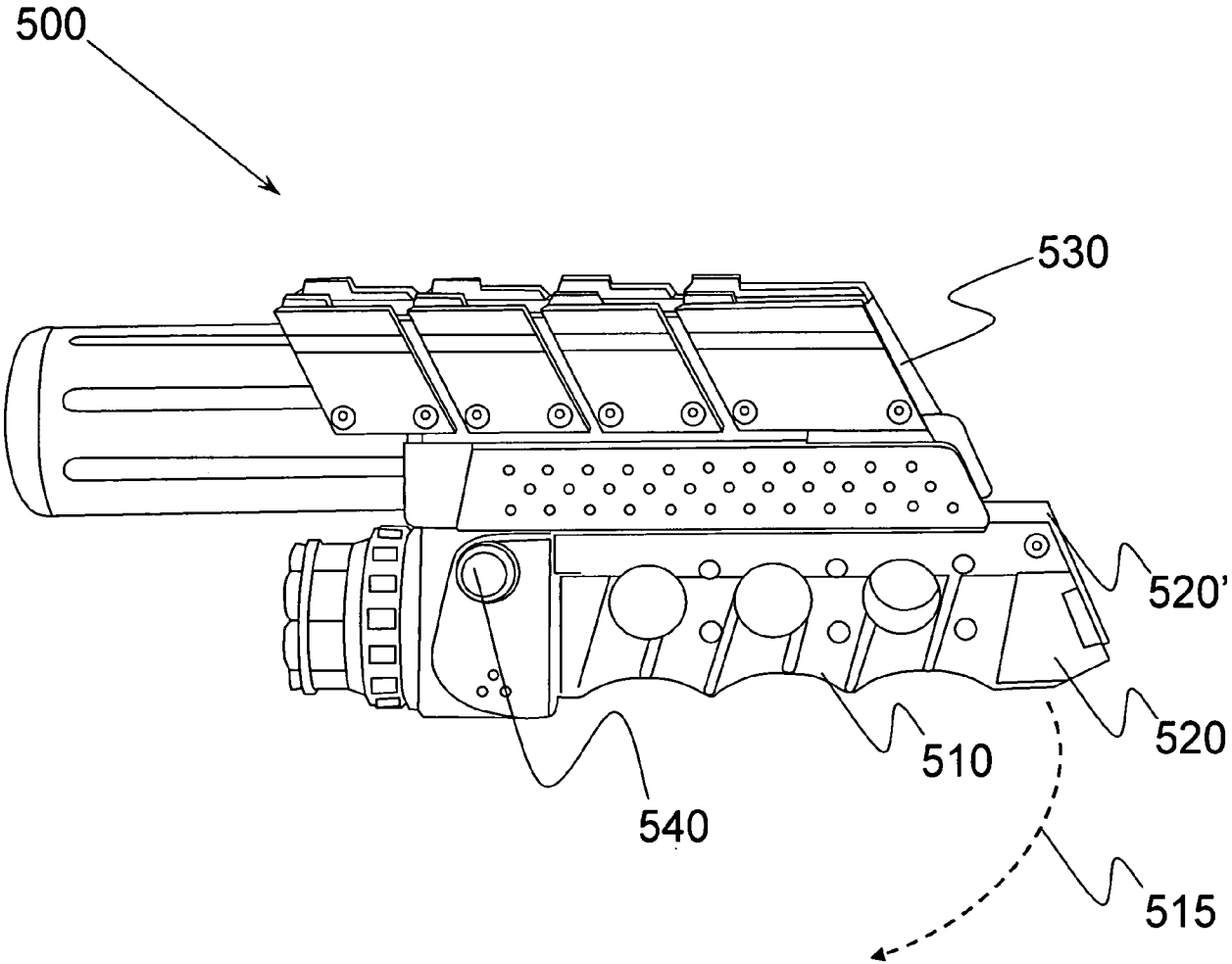
FIG. 5 is a side-view illustration of the toy gun barrel and collapsed support legs.

Referring to FIG. 5, a side view illustration of the toy gun barrel 500 and collapsed support legs 510 are shown. Typically, the toy gun barrel 500 is configured as a snap on barrel attachment. The collapsed support legs 510 may be used for extra stability when aiming at moving or stationary targets. To use the collapsed support legs 510, the user may gently rotate 515 the barrel handles 520 and 520' down until they lock into position. To return the barrel handles 520 and 520' to their stored position, the user may reverse the process by rotating the barrel handles 520 and 520' up into the body 510 of the barrel attachment.

To attach the toy gun barrel 500 to the toy gun, the user may slide the toy gun into the opening 530 found on the barrel attachment 500. Typically the toy gun will slide into the opening 530 to a predetermined point until an audible cue, such as a snap, is heard. The snap indicates that the barrel attachment 500 is locked into the proper position. The IR beam is not be affected by the barrel attachment 500. The IR beam is designed to pass through the barrel attachment 500.

To remove the barrel attachment 500, the user may press and hold a release button 540 (or other suitable release mechanism) and pull the barrel attachment 500 forward until the barrel attachment 500 is released from the toy gun.

(4) Game Settings

To provide a more realistic laser battle amongst users, the laser toy gun may be preprogrammed to fire a limited amount of shots before the laser toy gun is out of ammunition. The laser toy gun includes a RESET mechanism (e.g., button A) on the gun (e.g., right side) that may be configured to reload the gun. As a non-limiting example, activation of the A button may reload the toy laser gun with a total of 25 laser bursts.

A variety of settings may be selected from in order to increase or decrease the level of difficulty in winning a game. For example, a laser toy gun may be limited to the amount of "reloads" during any period.

(5) Laser Game

The laser toy gun may also be equipped with a feature to allow for team play. For example, a setting may be selected (e.g., a button may be physically switched) to allow a user to select from two or more teams. During team mode, for example, a user from one team will not be able to register direct hits to and/or from members of their own team.

The user versus user feature may be enhanced by a variety of preprogrammed sound and light sequences. For example, the user versus user mode may include a limited number of times by which any particular user may be hit. As a non-limiting example, a total of ten direct hits may be registered by a user before their laser toy gun is no longer operational. Upon receiving the predetermined number of direct hits, a sound alerting the user to the hit may be emitted and accompanied by flashing lights. Similar warning sequences may be programmed alerting the user to every received hit. Alternatively, a warning sequence may be preprogrammed to alert the user once a large proportion of their total available hits have been used up.

A radar feature may also be incorporated into the gun to enhance the team battle mode. For example, an audible alarm may alert the user when a member of an opposing team draws near. As one user approaches another the audible alarm may emit a sound to alert the user to the proximity of an opposing team's member. Such proximity sensing systems can be operated using any suitable proximity sensing mechanism or device, non-limiting examples of which include a global positioning system and frequency proximity sensors. The radar feature may strategically allow a user to avoid a direct hit from an opposing team member while in the opposing team member's kill zone. Alternatively, the radar mode may emit an audible alert indicating a locked on target.

Figure 6:
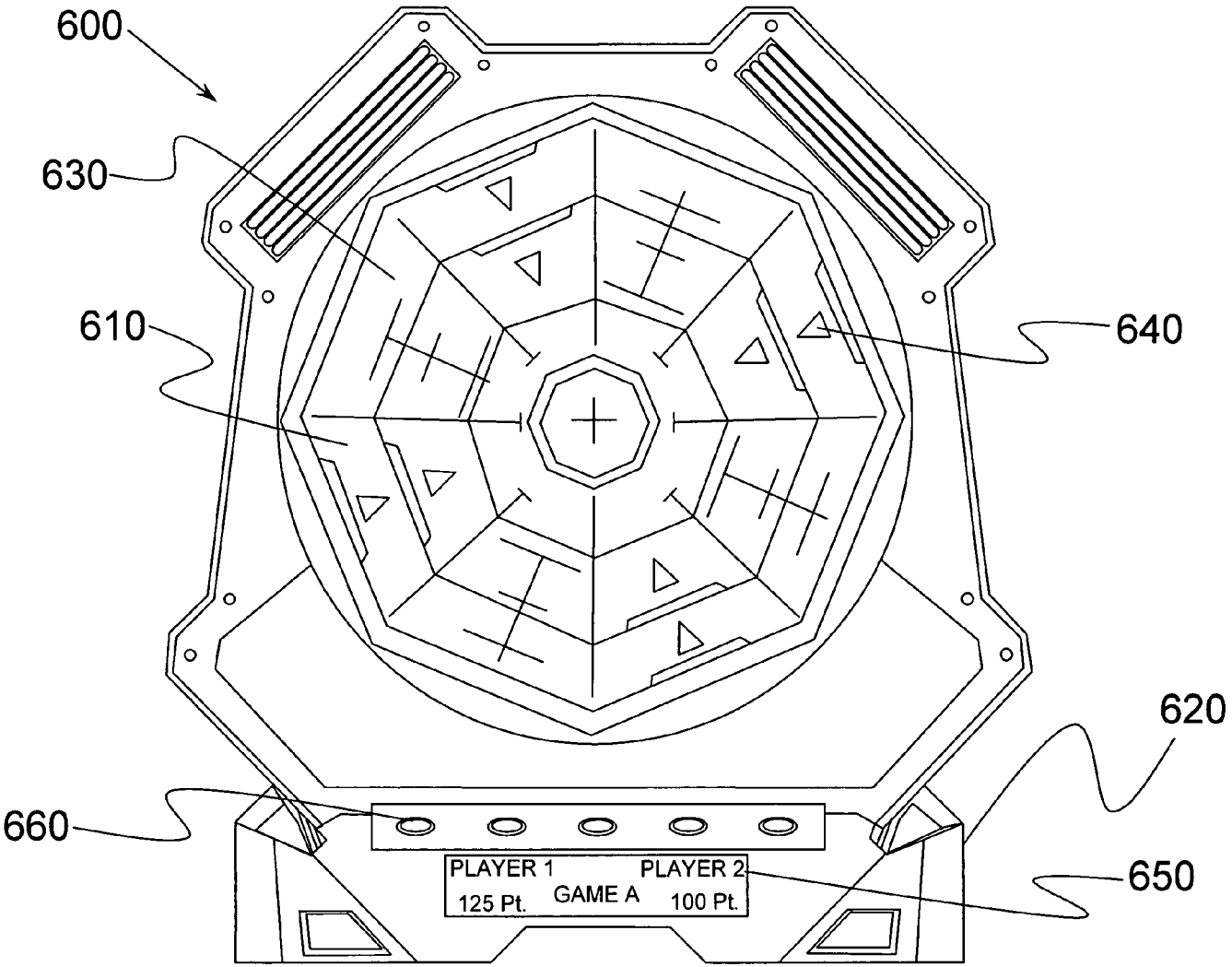
FIG. 6 is a front-view illustration of one embodiment of an electronic targeting system, depicting a target surface, a target base, a display screen, and a series of game mode buttons.

As shown in FIG. 6, the toy laser gun target 600 is an electronic target designed to detect laser-light from a toy laser gun. In one aspect, toy laser gun target 600 is programmed with at least one game for a user to play with a toy laser gun that requires the user to hit the toy laser gun target 600 at certain points in a specific sequence in order to win.

In another aspect, a multiplicity of users may engage in a game of tag. A toy laser gun is activated by toggling the ON/OFF switch located on the side of the toy laser gun to the ON position. Alternatively, the laser toy gun may be RESET by activating the RESET button on the side of the laser toy gun. The gun may also be reset by pointing one laser toy gun at another and pressing the RESET button. A sound or light-up display with flash may be activated to indicate the laser toy gun has been reset.

The toy laser gun target 600 comprises a target surface 610 supported by a target base 620, as illustrated in FIG. 6. The target surface 610, in one embodiment, is a material (e.g., black acrylic material) that can be backlit with a plurality of multi-colored lights 630 which illuminate different portions of the target surface 610. The black acrylic material eliminates the need for painted lines on the target surface 610, allowing the lines to be changed by the multi-colored lights depending on a game to be played by a user. The multi-colored lights 630 can be used to play a game, such as one that requires hitting only a certain color of light that appears, or hitting light that appears in a certain order. The target surface 610 also includes a plurality of laser-light sensors 640 to detect when a user hits the target surface 610 in a certain area with a laser-light emitting toy gun.

In one embodiment, the toy laser gun target 600 includes a display screen 650 to display information relating to the game, such as a user's score or information relating to the accuracy of the user's shots. The display screen 650, laser-light sensors 640, and multi-colored backlights 630 are all connected to a controller (not shown) placed inside the toy laser gun target 600. The controller is a processor such as an integrated circuit ("IC") chip which controls the game play and registers shots by a user during game play. The controller also causes the display screen 650 to display relevant game information during game play. The toy laser gun target 600 also includes a power supply to power the controller, multi-colored lights 630, and the display screen 650 during game play. The power supply is any suitable power providing system, non-limiting examples of which include a battery or converter and/or cord for connecting with an external power source.

In an additional non-limiting embodiment, a series of game-mode buttons 660 are positioned on the target base 610 so a user can select a type of game to be played. A variety of games can be played using the toy laser gun target 600, including games for multiple players. The games can all be programmed into the controller memory, such that activating one of the game-mode buttons 660 causes the controller to load and run the specified game.

In summary, the present invention is a toy gun capable of transmitting a laser beam and/or an IR beam of light for use in a game. The toy gun also has a detector for detecting a laser and IR signal.

What is claimed is:

1. A toy gun for transmitting laser and infrared (IR) beams, comprising:

a gun body having a barrel and a handle;

an IR beam generator attached with the gun body to generate and emit an IR beam;

a laser beam generator attached with the gun body to generate and emit a laser beam;

a trigger being functional for actuating at least one of the IR beam generator and the laser beam generator;

a controller for processing the signal from the trigger and causing the gun to generate at least one of the IR beam and the laser beam;

a scope attached with the gun body, wherein the scope comprises multiple lenses;

wherein each of the multiple lenses is a distinct lens that corresponds to a distinct viewing mode;

a viewfinder connected with the scope; and a switch rotatably connected with the scope, wherein a user rotates the switch to rotate through the multiple lenses to select one of the distinct lenses for alignment with the viewfinder in order to select a viewing mode corresponding to the distinct lens aligned with the viewfinder.

2. The toy gun of claim 1, further comprising a first barrel for transmitting the IR beam and a second barrel for transmitting the laser beam.

3. The toy gun of claim 2, further comprising a switch to permit the user to manually alter a function of the trigger between an IR beam generating function and a laser beam generating function.

4. The toy gun of claim 3, further comprising an IR beam detector connected with the gun body.

5. The to gun of claim 4, further comprising a laser beam detector connected with the gun body.

6. The toy gun of claim 5, wherein the laser beam is generated to include a beam width and further comprising a lens contained within the second barrel and positioned in line with the laser beam to modify the beam width of the laser beam.

7. The toy gun of claim 6, wherein the controller is configured to monitor a number of beams emitted by the toy gun and cease beam emission upon emitting a predetermined number of beams, and further comprising a reload mechanism connected with the controller such that upon actuation of the reload mechanism, the controller allows for an additional predetermined number of beam emissions, thereby simulating the reloading of a real gun.

8. The toy gun of claim 7, wherein the reload mechanism is a bolt-action slide mechanism.

9. The to gun of claim 8, further comprising a display screen connected with the gun body to display information relating to the use of the toy gun.

10. The toy gun of claim 9, wherein the display screen is a Liquid Crystal Display ("LCD") screen.

11. The toy gun of claim 10, wherein the scope is detachably attachable to the toy gun body.

12. The toy gun of claim 11, wherein the scope is formed to allow a user to switch between a normal view of a target area, a magnified view of the target area, and a cross-hair view of the target area where cross-hairs are positioned in a line of sight of the target area.

13. The toy gun of claim 1, further comprising a display screen connected with the gun body to display information relating to the use of the toy gun.

14. The toy gun of claim 13, wherein the display screen is a Liquid Crystal Display ("LCD") screen.

15. The toy gun of claim 1, further comprising a scope that is detachably attachable to the toy gun body.

16. The toy gun of claim 15, wherein the scope is formed to allow a user to switch between a normal view of a target area, a magnified view of the target area, and a cross-hair view of the target area where cross-hairs are positioned in a line of sight of the target area.

17. The toy gun of claim 1, further comprising a switch to permit the user to manually alter a function of the trigger between an IR beam generating function and a laser beam generating function.

18. The toy gun of claim 1, further comprising an lift beam detector connected with the gun body.

19. The toy gun of claim 1, further comprising a laser beam detector connected with the gun body.

20. The toy gun of claim 1, wherein the laser beam is generated to include a beam width and further comprising a lens positioned in line with the laser beam to modify the beam width of the laser beam.

21. The toy gun of claim 1, wherein the controller is configured to monitor a number of beams emitted by the toy gun and cease beam emission upon emitting a predetermined number of beams, and further comprising a reload mechanism connected with the controller such that upon actuation of the reload mechanism, the controller allows for an additional predetermined number of beam emissions, thereby simulating the reloading of a real gun.

* * * * *